US005318457A

United States Patent [19]

Harting et al.

[11] Patent Number: 5,318,457

[45] Date of Patent: Jun. 7, 1994

[54] ELECTRICAL PLUG AND SOCKET CONNECTION WITH HOUSING HALVES THAT CAN BE LOCKED

[75] Inventors: Dietmar Harting, Espelkamp; Hans-Peter Bollin; Günter Piewitt, both of Lübbecke; Albert Ferderer, Espelkamp, all of Fed. Rep. of Germany

[73] Assignee: Harting Elektronik GmbH, Espelkamp, Fed. Rep. of Germany

[21] Appl. No.: 21,372

[22] Filed: Feb. 23, 1993

[30] Foreign Application Priority Data

Feb. 27, 1992 [DE] Fed. Rep. of Germany ..... 4205960

[51] Int. Cl.[5] ..... H01R 13/627

[52] U.S. Cl. ..... 439/352; 439/357

[58] Field of Search ..... 439/345, 350, 352, 353, 439/354, 357

[56] References Cited

U.S. PATENT DOCUMENTS 3,569,903 3/1971 Brishka ..... 439/352

4,533,194 8/1985 Boichut et al. ..... 439/352 X

FOREIGN PATENT DOCUMENTS 2801595 7/1979 Fed. Rep. of Germany .

2907051 9/1980 Fed. Rep. of Germany .

8121263 2/1982 Fed. Rep. of Germany .

*Primary Examiner*—Daniel W. Howell

*Assistant Examiner*—Khiem Nguyen

*Attorney, Agent, or Firm*—Jordan and Hamburg

[57] ABSTRACT

For an electrical plug and socket connection with housing halves that can be locked together, for which a sleeve, which can be shifted in the longitudinal direction of the housing halves, is provided for cancelling the locking, it is proposed that the locking elements be constructed as latches, which grip behind the locking shoulder at the one half of the housing in order to lock the two halves of the housing together. For this purpose, the latches are provided with an inclined surface, which is acted upon by an edge of the sleeve to unlock the connection. When tension is applied to the sleeve in a direction opposite to the plug-in direction, the edge of the sleeve presses the latches out of the locking position.

9 Claims, 4 Drawing Sheets

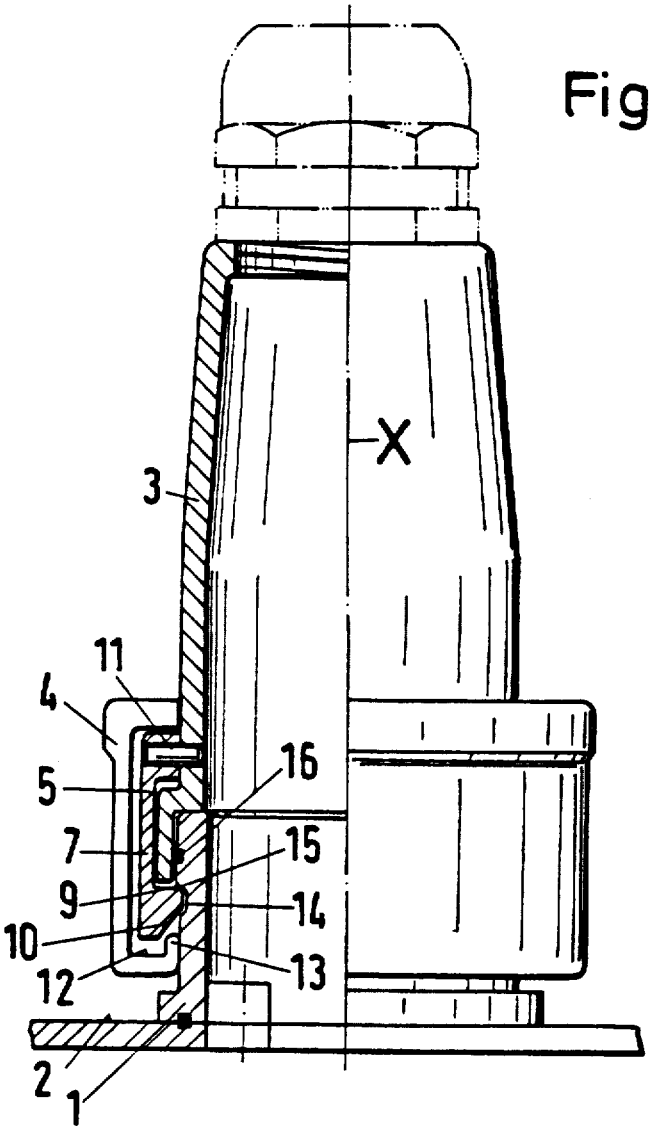
Fig.1
Fig.3
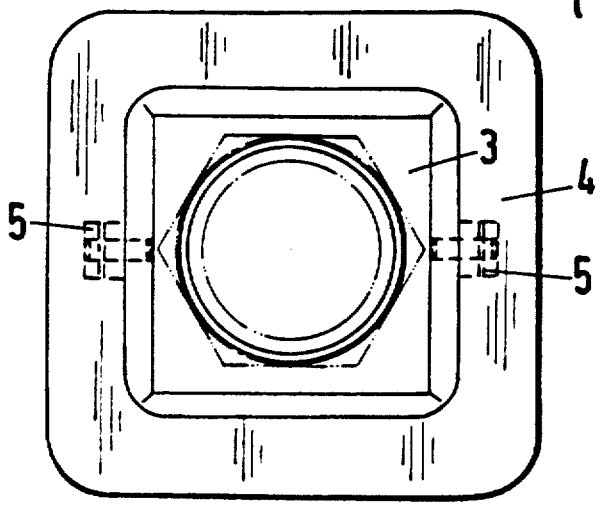

ELECTRICAL PLUG AND SOCKET CONNECTION WITH HOUSING HALVES THAT CAN BE LOCKED

BACKGROUND OF THE INVENTION

The invention relates to an electrical plug and socket connection with housing halves that can be locked, the one half of the housing being provided with locking elements, which, in the assembled state of the two halves of the housing, lock these together and the housing half, which is provided with the locking elements, being provided with a sleeve, which can be shifted in the direction of the longitudinal axis and cancels the locking when shifted against the plug-in direction of the two halves of the housing, so that the two halves of the housing can be separated.

For such plug and socket connections, it is necessary to lock the two halves of the housing positively with one another in the plugged-in state in order to prevent the unintentional loosening of the two parts of the connector during the operation due to vibrations, that is, due to tensile forces acting on the cable (connector part).

It is well known to screw together such plug and socket connections, particularly circular plug and socket connections by means of union sleeves, which are provided with a screw thread. Likewise, union sleeves with bayonet type locking mechanisms are known. Furthermore, the German Offenlegungsschrift 29 07 051 discloses an electrical connector with housing halves that can be locked, for which the locking of the two plugged-together halves of the housing is brought about by V-shaped locking elements, which engage the one half of the housing behind a locking projection. The separation of the two halves of the housing is prevented by a movable sleeve, which in the locked position prevents the locking elements sliding over the locking projection. To separate the two halves of the housing, the sleeve is pushed into a position, in which the locking elements are released and then can slide away over the respective locking projection. However, this locking system for the plug and socket connection, which is satisfactory on the whole, has a sophisticated construction and therefore cannot be produced inexpensively.

OBJECTS AND SUMMARY OF THE INVENTION

It is an object of the invention to construct an electrical plug and socket connection of the initially named type in such a manner, that the locking elements are constructed robustly and can be produced as simply and inexpensively as possible. Moreover, the locking shall become effective automatically, when the two halves of the housing are plugged together, without requiring separate manipulations. However, it shall be possible to separate the two halves of the housing only by means of special manipulations, which should again, however, be simple.

This objective is accomplished owing to the fact that the locking elements are constructed as inwardly elastic latches, which have a locking shoulder, adjoining which there is an inclined surface extending to the end of the latches, that the latches are fastened to one half of the housing and, in the assembled state of the housing halves, the locking shoulders of the latches grip behind the locking shoulders of the other housing half, that the axially movable sleeve is disposed at the housing half, which is provided with the latches and overlaps the latches, that the sleeve has a U-shaped, inwardly directed edge involving the formation of a pocket-like recess, the end of the latches dipping into this recess and the inner edge pointing against the inclination of the latch and, when the sleeve is shifted in the direction opposite to the plug-in direction of the two halves of the housing, the edge acts on the inclination of the latches in such a manner, that these are forced out of the locked position into the unlocked position.

The advantages achieved with the invention consist particularly therein that the plug and socket connection, which can be locked, has extremely simple and robust locking elements and therefore, on the one hand, can be produced inexpensively and, on the other, can also be used without problems in a rough environment.

Moreover, the plug and socket connection has a compact construction and a locking system, which can be operated in an ergonomically optimum manner. The inventive locking system can, moreover, be used for connectors of round construction as well as those of square or rectangular construction.

For plug and socket connections, which have a metallic housing and for which a continuous electric shielding shall be present, it is particularly advantageous to construct the locking elements so as to be springy also in the longitudinal direction of the plug and socket connection (in the plugging-in direction), the end surfaces of the housing halves being pressed elastically against one another in the assembled state.

BRIEF DESCRIPTION OF THE DRAWINGS

An embodiment of the invention is described in greater detail in the following and shown in the drawing, in which FIG. 1 shows a view of the locked halves of the housing in partial section, FIG. 3 shows the plan view of the housing halves of FIG. 1.

DETAILED DESCRIPTION OF THE PREFERRED EMBODIMENTS

Figure 2:
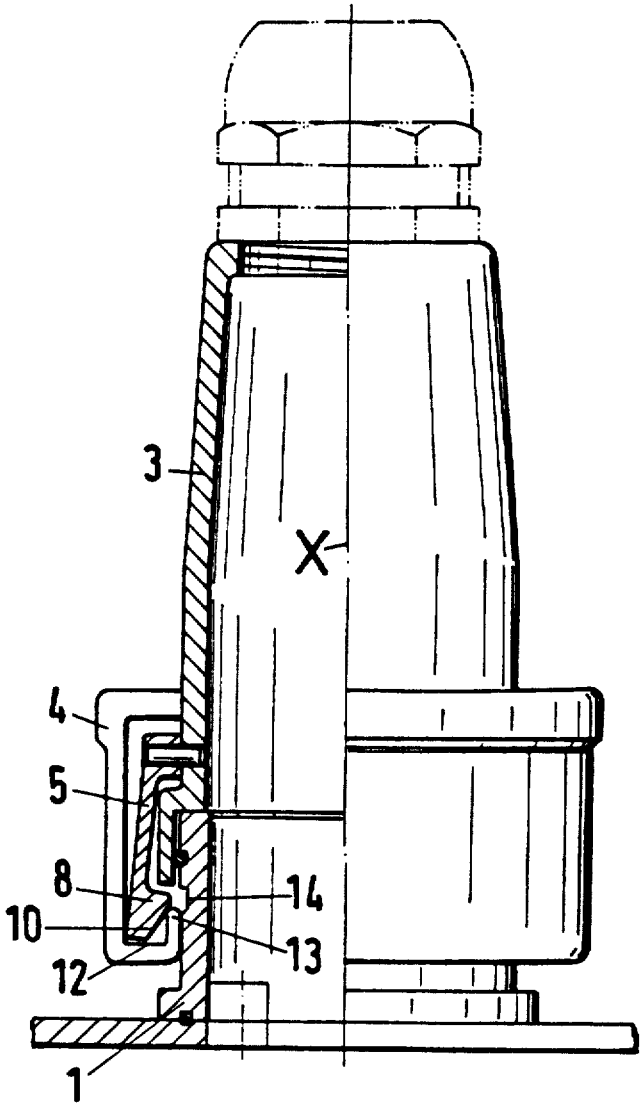
FIG. 2 shows a view of the housing halves of FIG. 1 in the unlocked state.

The plug and socket connection, shown in FIGS. 1 to 3, includes essentially a lower housing half 1, which is fastened to an installation surface 2, and an upper housing half 3, on which a sleeve 4 is disposed so that it can be shifted in the longitudinal direction of the axis X. In the housing halves, plug and socket connecting elements are disposed, which are not shown in greater detail here and are connected with one another so as to provide electrical contact when the housing halves are assembled. Within the sleeve, two locking elements are disposed, which are constructed as latches 5 and which, in the assembled state, lock the two halves of the housing to one another and secure them against unintentional separation.

Figure 4:
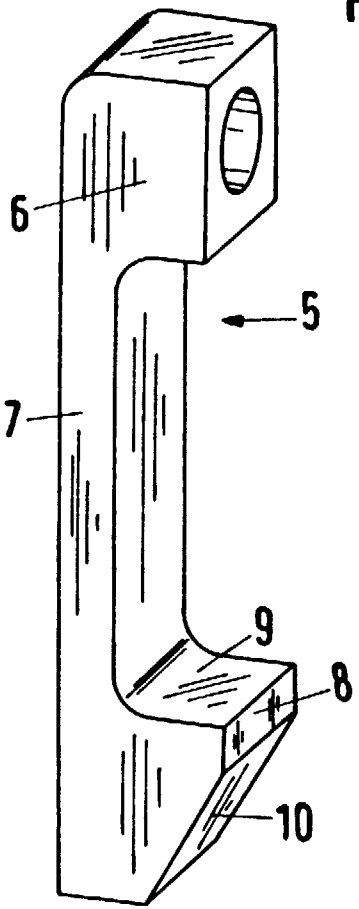
FIG. 4 shows the view of a latch.

The latches, of which one is shown on an enlarged scale in FIG. 4, are produced from a springy material such as a plastic and provided with an upper fastening shoulder 6, an elongated middle spring arm 7 and a locking hook 8 with a locking shoulder 9 at the end. Below the locking hook, an inclination 10 is constructed, the mode of action of which will be described further below.

The latches 5 are fastened by means of rivet bolts 11 or similar fastening means to the upper half of the housing. As mentioned further above, the latches are disposed within the movable sleeve 4. Moreover, the lower region of the sleeve, at least in the region of the latch, is U-shaped and provided with a pocket-like recess 12, which has an inwardly directed edge 13.

The lower end of the latch dips into this recess. Provisions can be made to ensure that the inclination 10 of the latches presses onto the edge 13 and that the latches therefore exert a force on the edge 13 and, with that, on the sleeve, which force presses the sleeve constantly in a direction opposite to the plug-in direction of the housing half, that is, into the locking position of the sleeve.

In the region of the locking hooks of the latches of the upper half of the housing 3 (as seen when the housing halves are assembled), the lower housing half is provided with recesses 14, which are engaged by the locking hooks 8 and, at the same time, can lock behind the locking shoulders 15 formed by the respective recess.

To seal the interior of the housing against moisture and foreign materials, an elastic seal 16 can be provided between the two halves of the housing.

Preferably, the sleeve 4 is composed of two half-shells, which are turned upside down over the housing half 3 and connected with one another.

The manner, in which the locking and unlocking is accomplished, is explained in the following. When the two halves of the housing 1, 3 are being assembled, the locking hooks of the latches are first of all pushed over the lower half 1 of the housing and, at the same time, bent slightly towards the outside. As the assembling is continued, the locking hooks finally reach the region of the recesses 14, into which they dip because of the elastic properties of the latches. Moreover, the locking shoulders 9 of the latches are locked together with the locking shoulders 15 of the recesses, as soon as the housing halves have been assembled completely. The two halves of the housing are thus firmly locked together and cannot be separated unintentionally by any axial tensile forces that may arise.

For deliberately separating the two halves of the housing, a tensile force is exerted on sleeve 4 in a direction opposite to the plug-in direction. In so doing, the edge 13 of the sleeve is then moved/forced against the inclination 10 of the latch 5, the latch being forced away to the side and the locking hook 8 moved out of the recess 14 (see FIG. 2). The locking is thus undone and a further pull on the sleeve or on housing half 3 brings about a separation of the two halves of the connectors.

Figure 7:
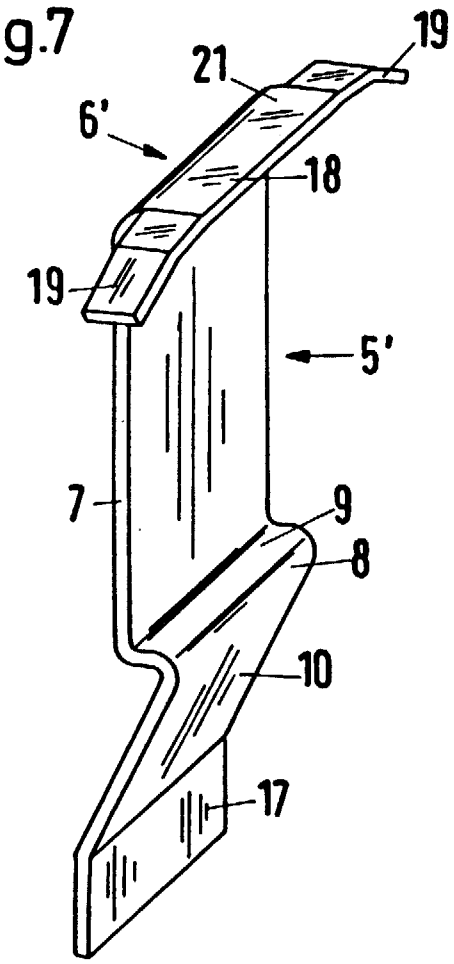
FIG. 6 shows the side view of the housing halves of FIG. 5 in section and FIG. 7 shows the view of a modified latch.
Figure 6:
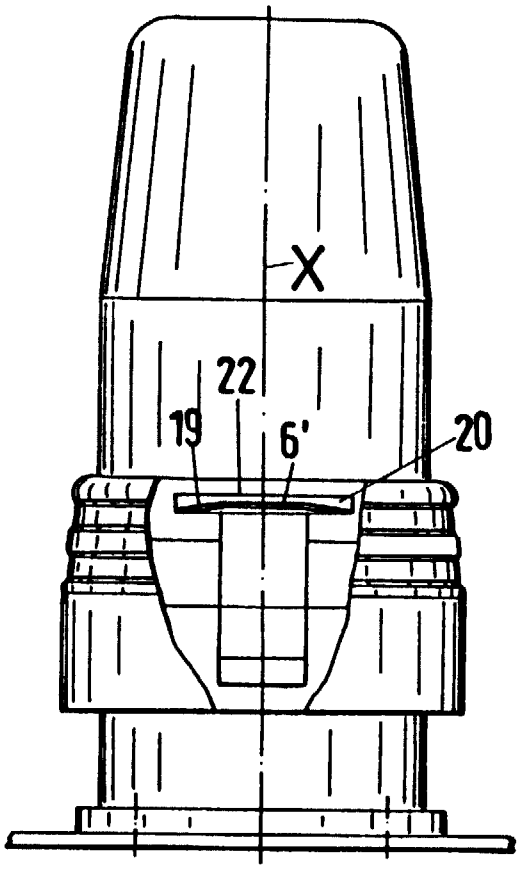
Figure 5:
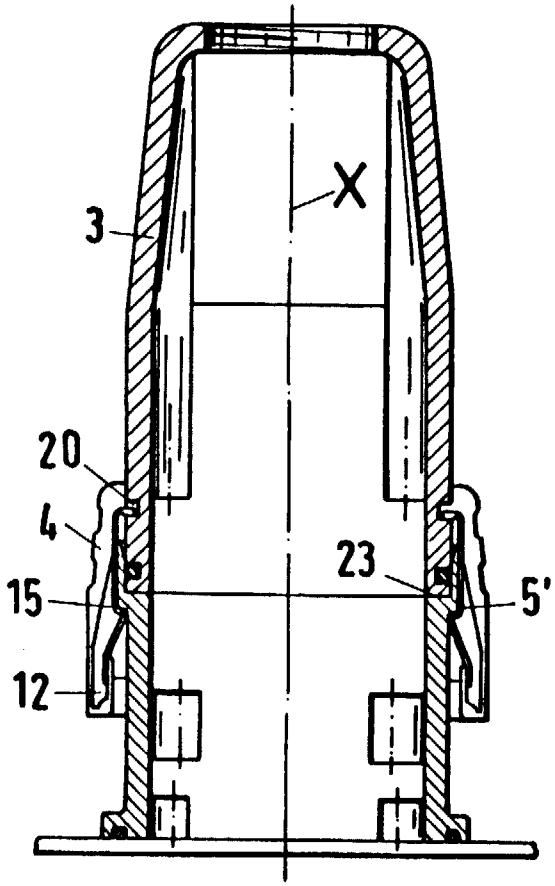
FIG. 5 shows the view of the locked housing halves with modified latches in section.

In FIGS. 5 and 6, a plug and socket connection is shown, which corresponds essentially to that shown in FIGS. 1 to 2. However, this plug and socket connection is provided with latch 5', which is shown on an enlarged scale in FIG. 7 and consists of a thin, springy sheet metal material. The sheet metal material is shaped or bent in such a manner, that this latch also has an elongated, central spring arm 7, a locking hook 8 with a locking shoulder 9 at one end, as well as an inclination 10. Below the inclination, a short, tab-like projection 17 is provided, which dips into the pocket-like recess 12 of the sleeve 4 of the upper half 3 of the housing. The construction of the upper fastening projection 6' is important for this sheet metal latch. For this, an angled section 18 is designated, which points inwards, that is, towards the housing half, and is provided with two lateral bends 19. To fasten it to the housing half 3 with the fastening projection 6', the latch 5', so constructed, is pushed into a pocket- or slot-shaped recess 20. The height of this recess is such, that the fastening projection 6' is clamped elastically in the direction of the axis X of the housing half into the recess over lateral bends, the upper side 21 of the fastening projection initially lying against the upper side 22 of the recess 20. The locking hook 8 of the latch is provided at such a distance from the fastening projection that, on assembling the two halves of the housing, the locking shoulder of the latch initially lies closely in front of the locking shoulder 15 of the lower half 1 of the housing. By exerting pressure on the sleeve 4 in the plug-in direction, as a result of which the sleeve exerts pressure on the upper side 21 of the latch, the latch is shifted so far in the plug-in direction (downwards), that the locking hook 8 or its locking shoulder 9 grasps behind the locking shoulder 15 of the lower half of the housing. While so doing, the fastening projection 6' was pushed downwards into the slot-shaped recess 20, the bends 19 exerting an elastic force on the latch against this displacement direction. The upper half of the housing is held firmly pressed against the lower half of the housing. If metallic housing halves are used, their end surfaces 23 are pressed together so as to make electrical contact and a continuous shielding of the plug and socket connection elements is thus ensured in the housing halves. Here also, the two halves of the housing are unlocked by pulling at the sleeve in a direction opposite to the plug-in direction, as described further above for the first embodiment.

We claim:

1. An electrical plug and socket connection extending along an axial direction, comprising:

a) a first housing half including at least one first locking shoulder;

b) a second housing half including:

i) locking element means for releasably locking together said first and second housing halves, said locking element means including a plurality of latches secured to said second housing half and elastically biased inwardly in a transverse direction of said connection, each said latch including:

A) locking shoulder means for gripping behind said at least one locking shoulder of said first housing half when said first and second housing halves are locked together, and B) an inclined surface at a free end of said latch, adjacent to said locking shoulder means;

ii) sleeve means for releasing said locking shoulder means from said at least one first locking shoulder to enable disconnection of the first and second housing halves, said sleeve means being arranged in surrounding relation to said latches and being displaceable in the axial direction of said connection, said sleeve means including an end having a substantially U-shaped cross-sectional configuration extending inwardly in said transverse direction so as to form pocket-like recess means for receiving the ends of said latches and so as to form inner edge means for abutting against said inclined surfaces of said latches to move said latches outwardly in said transverse direction when said sleeve is moved in said axial direction toward said second housing half and away from said first housing half; and iii) a flange in surrounding relation to a circumferential portion of said first housing half; and c) sealing means between said flange of said second housing half and said first housing half for sealing an interior of a housing formed by said first and second housing halves.

2. An electrical plug and socket connection according to claim 1, wherein said sleeve means is biased inwardly in said transverse direction.

3. An electrical plug and socket connection according to claim 1, wherein said inclined surfaces of said latches are in abutment with said inner edge means of said sleeve means and apply a biasing force thereto inwardly in said transverse direction.

4. An electrical plug and socket connection according to claim 1, wherein each said latch is made from a sheet metal-like spring material and includes a short angled section which forms said locking shoulder means.

5. An electrical plug and socket connection according to claim 4, wherein each said latch has a fastening end opposite the free end thereof, said fastening end including an angled section which extends inwardly in said transverse direction, said angled section including lateral bends;

said first housing half includes at least one slot-like recess for receiving said angled sections, wherein said locking shoulder means engage with said at least one first locking shoulder when end surfaces of said first and second housing halves are adjacent each other and when pressure is exerted on said sleeve means to apply a force on said angled section which causes elastic bending of said lateral bends and thereby causes said locking shoulder means to engage with said at least one first locking shoulder.

6. An electrical plug and socket connection according to claim 4, wherein each said latch further includes a tab-like projection connected to an end of said inclined surface and which is received in one pocket-like recess of said sleeve means.

7. An electrical plug and socket connection according to claim 1, wherein said first housing means includes at least one recess defined at least partially by said at least one first locking shoulder, and said second housing half includes a lower end, and said locking shoulder means extends past said lower end into engagement with said at least one recess.

8. An electrical plug and socket connection according to claim 1, wherein each said latch has a substantially U-shaped cross-sectional configuration with a fastening end secured to said second housing half and an opposite free end defining said locking shoulder means.

9. An electrical plug and socket connection extending along an axial direction, comprising:

a) a first housing half including at least one first locking shoulder and at least one slot-like recess; and b) a second housing half including:

i) locking element means for releasably locking together said first and second housing halves, said locking element means including a plurality of latches secured to said second housing half and elastically biased inwardly in a transverse direction of said connection, each said latch being made from a sheet metal-like spring material and including:

A) locking shoulder means for gripping behind said at least one locking shoulder of said first housing half when said first and second housing halves are locked together, said locking shoulder means being formed by a short angled section of said sheet metal-like spring material, B) an inclined surface at a free end of said latch, adjacent to said locking shoulder means, and C) a fastening end opposite said free end, said fastening end including a second angled section which extends inwardly in said transverse direction, said second angled section including lateral bends and being received in said at least one slot-like recess of said first housing half such that elastic bending of said lateral bends occurs to cause said locking shoulder means to engage with said at least one first locking shoulder of said first housing half when end surfaces of said first and second housing halves are adjacent each other; and ii) sleeve means for releasing said locking shoulder means from said at least one first locking shoulder to enable disconnection of the first and second housing halves, said sleeve means being arranged in surrounding relation to said latches and being displaceable in the axial direction of said connection, said sleeve means including an end having a substantially U-shaped cross-sectional configuration extending inwardly in said transverse direction so as to form pocket-like recess means for receiving the ends of said latches and so as to form inner edge means for abutting against said inclined surfaces of said latches to move said latches outwardly in said transverse direction when said sleeve is moved in said axial direction toward said second housing half and away from said first housing half.

* * * * *